US006599413B1

(12) United States Patent
Dekeyser et al.

(10) Patent No.: US 6,599,413 B1
(45) Date of Patent: Jul. 29, 2003

(54) METHOD AND APPARATUS FOR THE TREATMENT OF A MELT

(75) Inventors: Jacky Dekeyser, Neerpelt (BE); Derek John Fray, Cambridgeshire (GB); Robert Charles Copcutt, Cambridgeshire (GB); Gregory Doughty, Cambridgeshire (GB)

(73) Assignee: Foseco International Limited, Tamworth (GB)

( * ) Notice: Subject to any disclaimer, the term of this patent is extended or adjusted under 35 U.S.C. 154(b) by 0 days.

(21) Appl. No.: 09/700,415

(22) PCT Filed: May 14, 1999

(86) PCT No.: PCT/GB99/01355

§ 371 (c)(1),
(2), (4) Date: Feb. 6, 2001

(87) PCT Pub. No.: WO99/60180

PCT Pub. Date: Nov. 25, 1999

(30) Foreign Application Priority Data

May 15, 1998 (GB) ..... 9810305

(51) Int. Cl.[7] ..... C25C 3/08; C25C 3/00; C25B 11/12; C25B 11/04; C25B 13/00

(52) U.S. Cl. ..... 205/354; 205/367; 205/687; 204/241; 204/244; 204/245; 204/246; 204/247; 204/292; 204/294; 204/295

(58) Field of Search ..... 205/713, 367, 205/354, 366, 372, 377, 392, 687; 204/241, 244–247, 292, 294, 295

(56) References Cited

U.S. PATENT DOCUMENTS

| | | | | | |
|---|---|---|---|---|---|
| 1,980,378 | A | * | 11/1934 | Burgess | 205/341 |
| 4,108,743 | A | * | 8/1978 | Minck | 205/367 |
| 4,118,292 | A | * | 10/1978 | Fray et al. | 205/348 |
| RE30,330 | E | * | 7/1980 | Das et al. | 205/377 |
| 4,214,956 | A | * | 7/1980 | Bowman | 205/377 |
| 4,853,094 | A | * | 8/1989 | Honders et al. | 205/363 |
| 4,882,017 | A | * | 11/1989 | Weaver | 205/363 |
| 5,976,345 | A | * | 11/1999 | Pal et al. | 205/336 |

FOREIGN PATENT DOCUMENTS

| | | | |
|---|---|---|---|
| EP | 0 688 881 A | | 12/1995 |
| EP | 0688881 A1 | * | 12/1995 |

* cited by examiner

*Primary Examiner*—Donald R. Valentine
(74) *Attorney, Agent, or Firm*—Nixon & Vanderhye P.C.

(57) ABSTRACT

A method and apparatus for adding a metal, for example sodium, to a melt of a material, for example aluminum, in a vessel, in which a molten compound of the metal or a solution of a compound of the metal is provided in a container (12), the container being positioned outside the vessel, the compound is electrolytically decomposed and ions of the metal are caused to pass through a wall of a solid-state electrolyte (14) which is a conductor therefor, from a first side of the wall to an opposite second side thereof, and to combine with electrons at the second side of the wall and then to flow as molten metal from the container into the melt in the vessel.

29 Claims, 6 Drawing Sheets

86
80
84
78
73
85
81
87
82
83
88
77
89
76
90
75
91
69
92
94
93
70
71
74
72
73
79

METHOD AND APPARATUS FOR THE TREATMENT OF A MELT

BACKGROUND AND SUMMARY OF THE INVENTION

This invention relates to the addition of trace amounts of metal to a melt.

It is particularly concerned with the addition of a metal from Group 1A of the Periodic Table to a melt of another metal, e.g. aluminium or zinc. Thus the Group 1A metal may be, for example sodium or lithium.

The invention is most preferably concerned with the addition of sodium to molten aluminium or an aluminium alloy and, although it will be appreciated that it is not intended to be limited thereto, it will be described for convenience below with specific reference to those metals.

The addition of trace amounts of sodium, e.g. amounts less than about 200 ppm, to an aluminium melt is well known. It can result in improved quality of castings and the castings can be more easily removable from the mould and subject to a reduction in shrinkage.

Conventionally, sodium has been added to the aluminium melt in metallic form as sticks or in aluminium cans or in the form of tablets of a sodium compound and while these methods have the advantage of simplicity they are very inefficient. Owing to the violence of the reaction that occurs much of the added sodium is lost by oxidation and considerable smoke generation is caused. Frequent additions are, therefore, necessary and the method is very wasteful, environmentally unfriendly and cannot provide a controlled amount of effective addition.

A method of overcoming these disadvantages is disclosed in EP-A-0688881. This teaches a method of adding sodium to a melt of aluminium or aluminium alloy in which an electrode comprising molten sodium or a molten sodium compound is immersed in the aluminium melt and is separated from the melt by a solid-state electrolyte which conducts sodium ions. A direct voltage is provided between that electrode and the melt by the provision of a second electrode in the melt. While providing a number of advantages in principle, this technique can lead to problems in the melt, e.g. if there is any failure of the solid-state electrolyte container.

It is an object of the present invention to provide a further improved means of metal addition.

Accordingly, the invention provides a method of adding a metal to a melt of a material in a vessel, in which a molten compound of the metal or a solution of a compound of the metal is provided in a container, the container being positioned outside the vessel, the compound is electrolytically decomposed and ions of the metal are caused to pass through a wall of a solid-state electrolyte which is a conductor therefor, from a first side of the wall to an opposite second side thereof, and to combine with electrons at the second side of the wall and then to flow as molten metal from the container into the melt.

In another aspect the invention provides an apparatus for adding a metal to a melt of a material in a vessel, the apparatus comprising a container for a molten compound of the metal or a solution of the compound of the metal, the container being positioned outside the vessel, means to electrolytically decompose the molten or dissolved compound, a wall positioned inside the container and formed of a solid-state electrolyte which is a conductor for ions of the metal, whereby the metal ions formed can pass through the wall from a first side to an opposite second side thereof, a source of electrons at the second side of the wall to combine with the metal ions, and means to pass the molten metal so formed from the second side of the wall into the melt.

For embodiments of the invention in which the container is for a molten compound of the metal, the apparatus preferably includes means to heat the compound of the metal to molten form.

For embodiments of the invention in which a solution of a compound of the metal is used, the solvent is preferably an organic solvent, for example acetamide or glycerol. When a solvent is used, the invention preferably includes means for preventing substantial loss of the solvent through evaporation or boiling.

As indicated above, the melt in the vessel will normally be a metal melt, e.g. of zinc or, preferably, aluminium but it will be appreciated that the invention is applicable in principle to non-metallic melts.

Also as indicated above, the metal to be added to the melt will normally be a metal of Group 1A of the Periodic Table and the invention is particularly useful for the addition of sodium.

The metal compound is preferably an ionic compound but the invention is equally applicable to the use of non-conducting metal compounds. A mixture of a plurality of metal compounds (ionic or non-ionic) may be used.

Where the or each metal compound is ionic, current may be passed between a first electrode positioned in the molten compound and a second electrode positioned beyond or at the second side of the wall of the solid-state electrolyte, whereas if one or more non-conducting metal compounds is/are used, the first electrode should be porous and be positioned to lie on the first side of the wall.

Thus electrolytic decomposition of the metal compound is effected, molten metal being discharged at the second electrode and anionic species being discharged at the first electrode. The metal compound is preferably a metal salt, for example a metal hydroxide, carbonate or oxalate salt. The anionic species preferably discharge to form one or more gases, e.g. where sodium hydroxide is used as the metal compound, water vapour and oxygen are produced, and where sodium carbonate is used as the metal compound, carbon dioxide and oxygen are produced. (It will be appreciated that where water vapour is produced, it should normally be ducted away to prevent any possible contact with the melt in the vessel.)

At the start up of the process, priming may be needed at the second side of the wall of the solid-state electrolyte. This may be achieved by contact between the second side and the second electrode or by the provision of an amount of the molten metal.

The wall of solid-state electrolyte may conveniently form a container. In one embodiment this container also provides the container in which the metal compound is held. Thus the first electrode for the required passage of current extends into the metal compound in the container or lies on the interior (first side) of the wall. The metal ions, therefore, pass through the container wall to the outside, are discharged and liquid metal then passes from the outside of the wall via a passage to the melt in the vessel. In a second embodiment the container formed of solid-state electrolyte is positioned inside another container. This outer container may conveniently act as one of the electrodes for the required passage of current.

In this second embodiment the metal compound may either be contained in the inner solid-state electrolyte container or outside that container but inside the outer container. The metal ions then either flow through the wall of the inner container from the inside to the outside or vice versa and the electrical circuitry is arranged accordingly as desired. Liquid metal is, therefore, provided with a passageway from inside or outside the inner container, as appropriate, to the melt in the vessel.

The electrodes may be formed of any suitable electrically conducting materials. Thus the first electrode may be formed, for example, of nickel, stainless steel or graphite and the second electrode may be formed, for example, of nickel, iron or steel depending on the metal compound used.

Where the metal to be added to the melt is sodium, the sodium compound to provide the source of sodium ions may be, for example, as indicated above, sodium hydroxide or sodium carbonate. Whatever compound is used, it should preferably be compatible with the solid-state electrolyte, should preferably be non-toxic and should preferably produce harmless by-products.

Where it is desired to use sodium carbonate, it may be preferable to mix it with a proportion of sodium chloride to reduce the melting temperature of pure sodium carbonate from 858° C. to, say, about 635° C. for the mixture. (It will be appreciated that in these circumstances the chloride ions will not be discharged.) Similarly, where it is desired to use sodium hydroxide, it may be preferable to mix it with a proportion of sodium carbonate to reduce the melting temperature of pure sodium hydroxide from 322° C. to about 285° C. for the mixture.

Where the device is operated at an elevated temperature, care may need to be taken during the addition of metal compound to replenish that used up in the process, because thermal shock could, for example, damage the solid electrolyte. The fresh compound may, for example, be added at a steady slow rate, or the solid electrolyte may be constructed to withstand thermal shock. This may, for example, be achieved by ensuring that the electrolyte has a radius of curvature, preferably a small radius of curvature, in all areas in at least 2 directions. For instance, in the case of tubular shaped electrolytes, the diameter would be reduced to the smallest practical value. Also, solid electrolytes such as beta alumina may be toughened by including about 12% zirconia in its structure. However, the preferred method in the invention is to use a separate compartment where the fresh metal compound is heated to a temperature close to that of the liquid surrounding the solid electrolyte. In one embodiment of the invention solid sodium hydroxide is melted in a separate container and the molten salt from this container is fed to the electrolysis section to keep the molten salt level there at a reasonably constant level. In a second embodiment, an aqueous solution of sodium hydroxide is dropped into a container of molten sodium hydroxide. Rapid drying and melting of the solution results. Again, the drying compartment is preferably sufficiently separated from the electrolysis compartment to prevent the solid electrolyte being damaged by thermal shock or chemical attack by water.

The power supply for the electrolysis process frequently constitutes a major part of the total cost, so attention is preferably given to minimizing its power and size. The voltage requirement may be minimized by using an easily decomposed salt, and by ensuring that all current carrying parts are as short as possible and have the highest cross-sectional area that is practical. The current requirement can be reduced by eliminating intermittent operation of the device. Since metal is often required to be introduced into the vessel in an intermittent mode, the invention preferably includes means for storing a small amount of metal within the device until it is needed. A means is then also included to feed the stored and produced metal when required. However, metallic sodium and other group 1A metals present a safety problem, therefore the apparatus preferably includes means to ensure that the minimum amount of metal is present at any given stage of the addition process. For this reason pressurized inert gas is the favoured method for pumping the molten metal from the electrolysis compartment into the vessel. Where a secondary pumping system is used to move metal from the apparatus to the vessel, it is desirable to include a sensor for the flow of metal so that the flow can be set at an optimum rate. Such a sensor may also aid in the detection of blockages in the metal feed pipe, for example. In the case where gas pressure is used, one or more gas pressure gauges are preferably used.

The solid-state electrolyte for sodium addition is preferably of sodium beta alumina. Sodium beta alumina has a sodium ion conductivity similar to that of molten salts with a negligible electronic conductivity over a wide temperature range but any other suitable sodium ion conducting electrolyte may be used. The solid-state electrolyte for lithium addition is preferably lithium beta alumina although, again, any other suitable lithium ion conducting electrolyte may be used.

Thus it is possible by means of the present invention to control the addition of metal to a melt by controlling the charge across the solid-state electrolyte. The amount of material that is pumped through the solid-state electrolyte is determined by Faraday's law. For 26.8 ampere hours one mole of monovalent ionised metal is pumped through the solid-state electrolyte.

A sensor for the added metal, e.g. for sodium, can be inserted into the melt and the addition of the metal monitored and controlled up to a predetermined, desired level.

It can then be maintained at that level without need to add excess, thereby significantly reducing waste and fume and dross production and these advantages are achieved without any risk of failure of a container within the melt.

A substantial amount of gas may be given off during the method, so that the arrangement of the first electrode should preferably be such as to minimise the effect of the gas on the electrolytic process. For example, gas produced by the electrolysis may have difficulty escaping between the anode and the electrolyte. The distance between the anode and the electrolyte may need to be a compromise between being sufficiently small to provide efficient electrolysis and sufficiently large to enable gas produced at the anode to escape. In one embodiment, use is made of the fact that gas produced at the anode will decrease the overall density of the source material (i.e. molten metal compound or metal compound solution) into which it discharges. This density difference is used to create a flow of source material between the anode and the source material in a direction which aids the removal of gas from this region. Additionally or alternatively, a pump can be used to circulate the source material and thus aid the removal of the gas. Advantageously, the anode may be gas permeable, for example porous. The first electrode may, for example, comprise a gas permeable electrically conductive layer on the solid-state electrolyte.

The arrangement of the second electrode relative to the container can be such as to minimise the inventory of molten metal. Alternatively, the molten metal can be produced electrolytically on a continuous basis and maintained in a reservoir between the container and the vessel and pumped through as and when required. The rate of electrolysis can thereby be boosted.

The first electrode may, for example, be generally in the form of a cylinder, preferably a hollow cylinder. Advantageously, the first electrode and the solid-state electrolyte may be shaped such that they are separated by an approximately constant minimum distance over substantially their entire opposing surfaces. This may substantially prevent the formation of a concentration of current at a particular point in the solid-state electrolyte, which could cause its premature failure. This is particularly important when the electrolyte is formed from beta alumina.

The apparatus of the invention preferably includes a control means, for example a timer and/or a monitoring means, which causes the molten metal compound or metal compound solution to be replaced periodically; the method of the invention preferably includes a step of replacing the molten metal compound or metal compound solution periodically. This periodic replacement (or "flushing-out") of the molten metal compound or metal compound solution preferably substantially prevents the build-up of precipitates which may, for example, be formed from impurities or from reaction of the metal compound with air. For example, if sodium hydroxide is used as the source material for the metal (in this case, sodium), it may react with carbon dioxide in the air to form carbonate which will normally electrolytically decompose more slowly than the sodium hydroxide and may therefore build up with time and form a precipitate which could form a blockage. Alternatively, the production of carbonate may increase the melting point of the source material above the operating temperature, causing solidification which may prevent the source material contacting the first electrode.

As the container in the apparatus of the invention is positioned outside the vessel containing the melt, a wider range of operating temperatures of the container can be employed enabling a wider range of metal compounds to be used. In particular, the operating temperature of the apparatus may be minimized (compared to that of the melt vessel) thereby normally enabling the use of more economical materials and a simpler construction. Sealing of the system, if required, is also generally more easily implemented.

Moreover, the design of the apparatus of the invention avoids the thermal shock problems associated with the prior art designs where the container has to be immersed in the melt in the vessel and, particularly for aluminium melts, overcomes the problem that solid-state electrolytes are unstable in molten aluminium.

The apparatus preferably includes a conduit, for example a feeding tube, to transport the molten metal to the melt. The conduit may be fully enclosed so that the metal is isolated from the external environment, for example it may be submerged in the melt. This is particularly important for the addition of sodium, for example. The conduit may be a simple tube or the like, but it is preferably a rotor, for example as illustrated schematically in FIG. 5. The conduit may be formed from a refractory material, e.g. a ceramic material (alumina is one possibility), or it may be formed from a metal which has a higher melting point than the temperature of the melt, e.g. it may be formed from steel.

Alternatively, the apparatus may include means, preferably a pump, which conveys the melt material out of the vessel for addition of the metal to the melt material in a location exterior to the vessel. Preferably, the melt material is conveyed into, or adjacent to, the apparatus for addition of the metal to the melt material in, or adjacent to, the apparatus.

The apparatus will normally include an outer housing enclosing the other components, for example for thermal insulation (to protect the operators) and also to aid its positioning and mounting with respect to the melt vessel.

BRIEF DESCRIPTION OF THE DRAWINGS

Embodiments of the invention will now be described, by way of example, with reference to the accompanying drawings, of which.

DETAILED DESCRIPTION OF THE DRAWINGS

Figure 1:
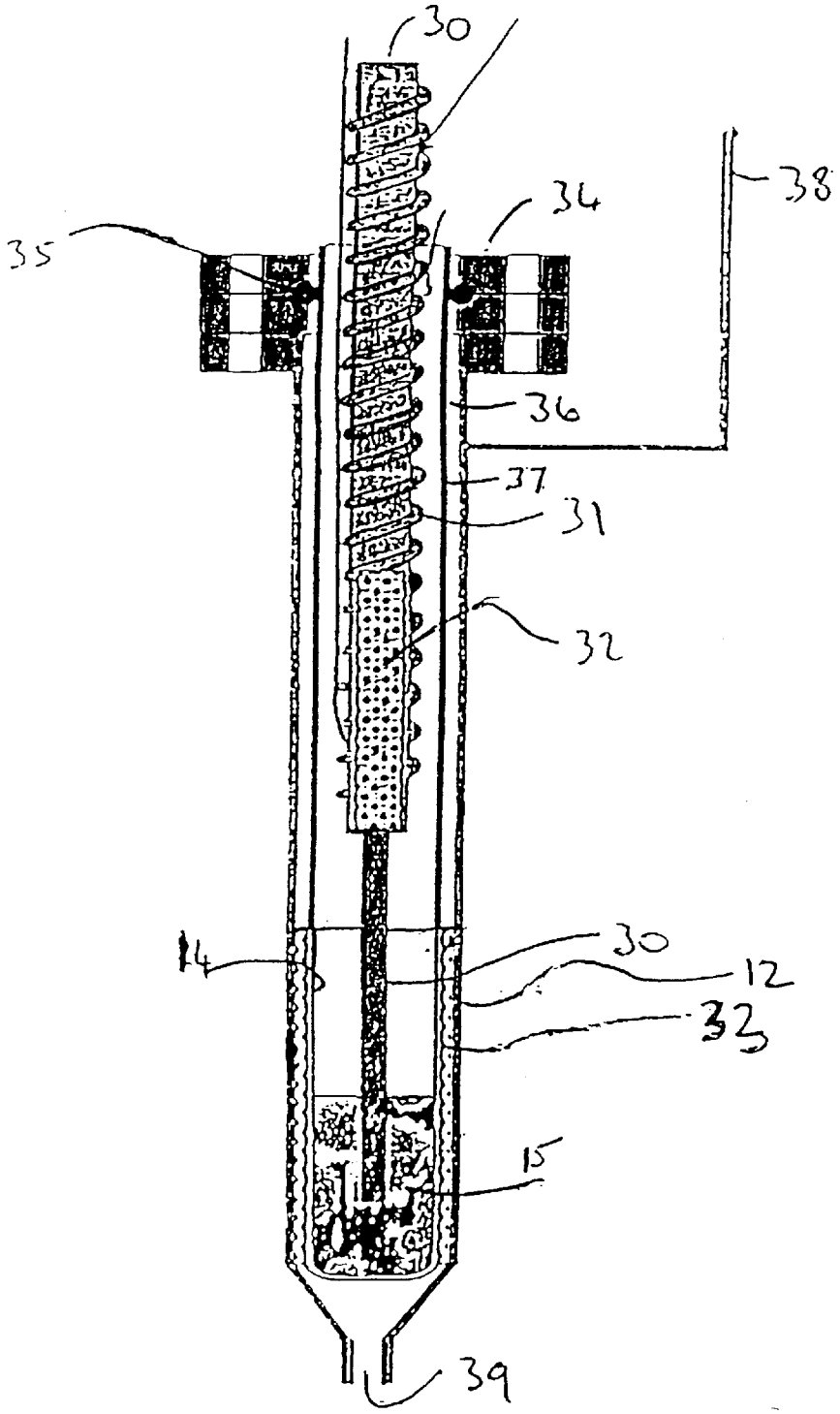
FIG. 1 is a detailed view in part section of a container for a metal addition compound for use in an arrangement according to one embodiment of the invention.

In FIG. 1 is shown one arrangement of a stainless steel container 12 and a beta alumina thimble 14.

Thimble 14 of sodium beta alumina sits inside container 12 and the thimble contains a pool 15 of molten sodium compound at its lower end. A nickel tube anode 30 extends down towards the bottom of thimble 14 into the pool of molten sodium compound 15 and has a heating element 31 wrapped around its upper extent to provide the means of melting the sodium compound. The tube contains a mesh 32 of nickel to prevent the sodium compound passing through until molten.

The container 12, which acts as a cathode, is in contact with a mesh 33 of steel, which lies between container 12 and thimble 14 and provides an electrical path between them.

The container 12 has an external collar 34 adjacent its upper end whereby it may be supported by attachment to a suitable structure at any desired location. A heat resistant sealing ring 35 seals the annular space 36 between the inner and outer containers, i.e. container 12 and an upper extension 37 of thimble 14. This upper extension may be formed of alpha alumina or any other material compatible with beta" alumina. An inlet 38 for an inert gas, e.g. argon, leads into annular space 36 to prevent unwanted oxidation reactions and/or to reduce the inventory of molten sodium.

On passage of current sodium ions present in the molten compound pass through the wall of the thimble, discharge and molten sodium then flows downwardly through exit 39 at the base of container 12 and into a container of an aluminium melt (not shown).

Figure 2:
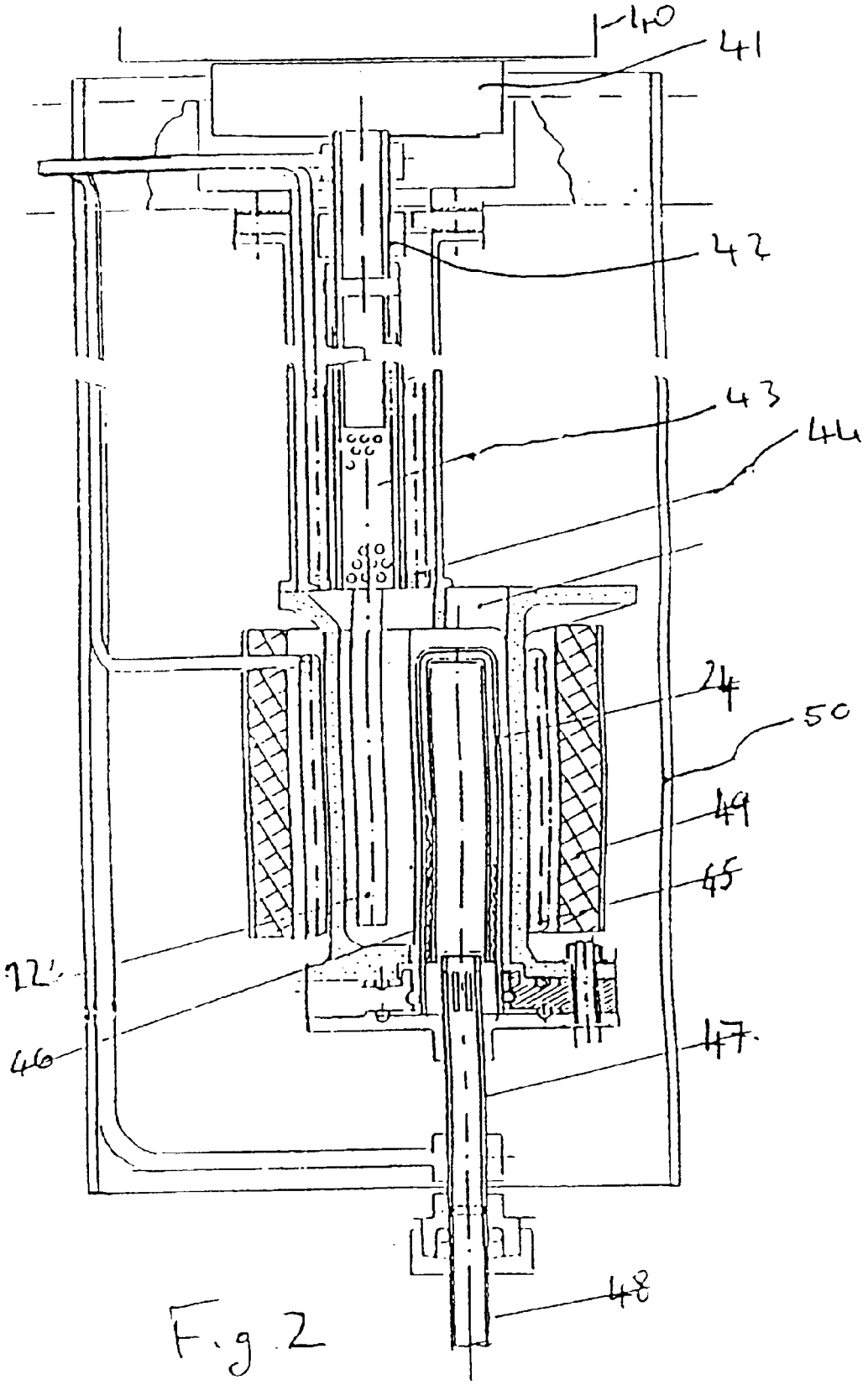
FIG. 2 is a similar view of an arrangement according to an alternative embodiment of the invention.

In FIG. 2 is shown an arrangement of a container 23 and a thimble shaped solid electrolyte 24 in which the thimble again lies inside the container but a molten sodium compound in container 23 lies outside thimble 24, the thimble extending into the molten compound.

In this arrangement a solid compound of sodium is fed downwardly from a hopper 40 via a feeder 41 to a tube 42 having an external nickel mesh 43. A heater 44 surrounds the lower portion of tube 42 whereby the solid sodium compound, which is held by mesh 43, may be melted. The molten compound flows downwardly into container 23, which contains a nickel tube 22 which acts as an anode. Container 23 is surrounded by a heater 45 to maintain the compound in its molten state.

Inside container 23 is a sodium beta alumina thimble 24. The base of thimble 24 leads into a passageway provided by a stainless steel cathode tube 47, which extends right into the thimble. The passageway leads via an alumina feed tube 48 to a vessel containing an aluminium melt (not shown). Lying between and in contact with the thimble 24 and cathode 47 is a steel mesh 46 which provides an electrical path between them.

Container 23 and heater 45 are surrounded by insulation 49 and the apparatus is maintained entirely within a protective cover 50 through which tube 47 extends.

On passage of current sodium ions present in the molten compound pass through the wall of thimble 24 to its interior, discharge and molten sodium then flows downwardly through tubes 47 and 48 to the aluminium vessel. The gas formed during the process escapes upwardly through a vent 51 at the upper end of container 23.

In this arrangement gas can be evolved outside the thimble where it can escape more easily.

Figure 3:
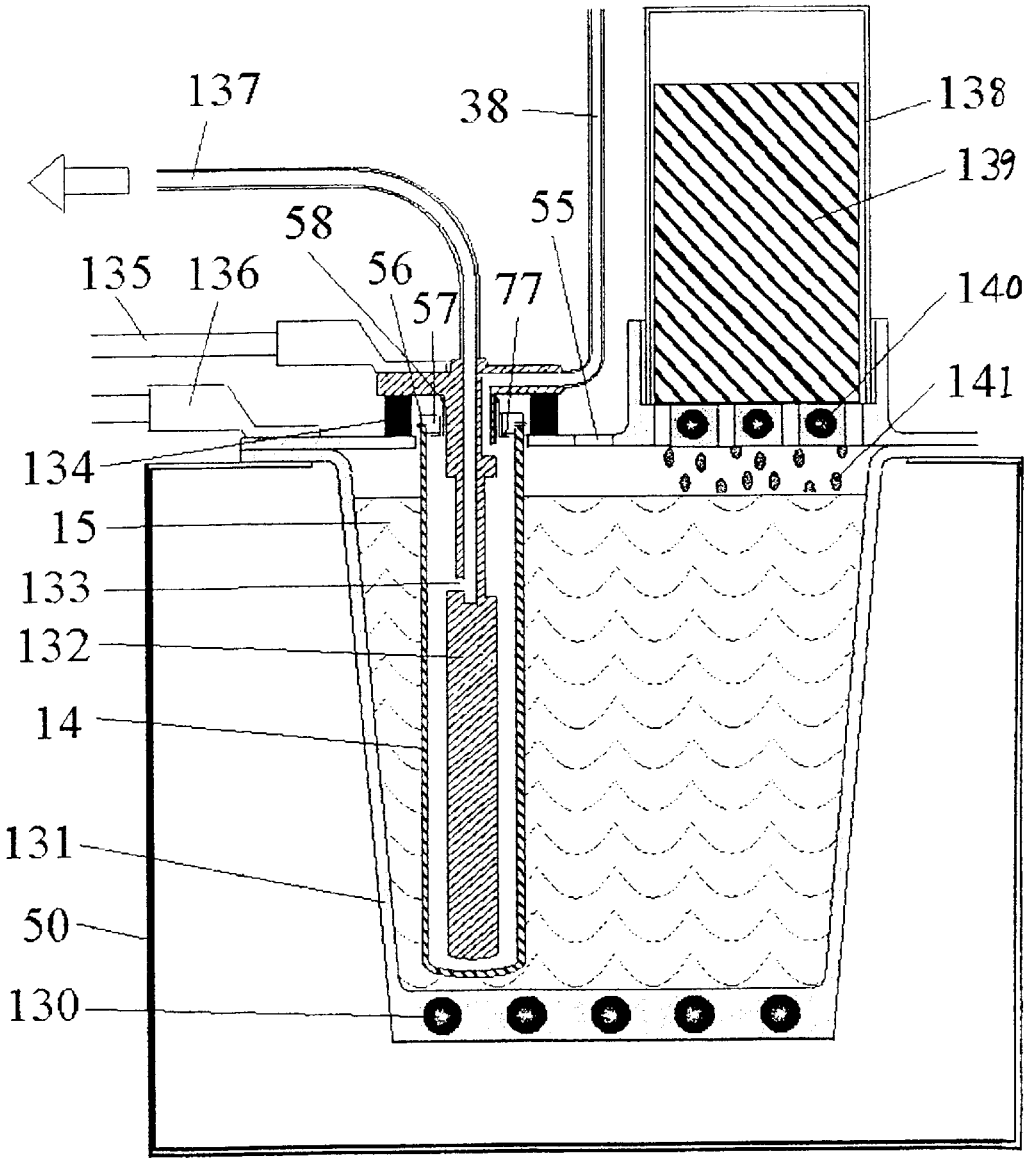
FIG. 3 is a cross-sectional representation of another embodiment of the invention.

FIG. 3 shows an alternative method for sealing the cathode 132 to the thimble shaped solid electrolyte 14. A hermetic seal is formed between the thimble and the alumina ring 57 by a suitable glass or cement seal at 56. An L cross-section ring made from a thin section of metal is attached to the alumina ring at point 77. The metal ring is then welded to the cathode at point 58 using a suitable technique such as laser welding. This assembly is then positioned in the anode/source material container 131 using support ring 134. When electrolysis has produced enough metal for it to fill the electrolyte to the level of the port 133, metal can be pumped through pipe 137 into the melt in the vessel by feeding inert gas through pipe 38.

The source material 15 in anode/container 131 is heated to the desired temperature using heater 130. Fresh source material 139 in container 138 is added by melting it with heater 140 and the drops of molten material are shown schematically (141).

Electrical power for electrolysis is provided to the cathode by cable 135 and 136 is the electrical connector to the anode. Gas created by the electrolysis process escapes through port 55. The whole unit is mounted and protected by enclosure 50 which may contain thermal insulation.

Figure 4:
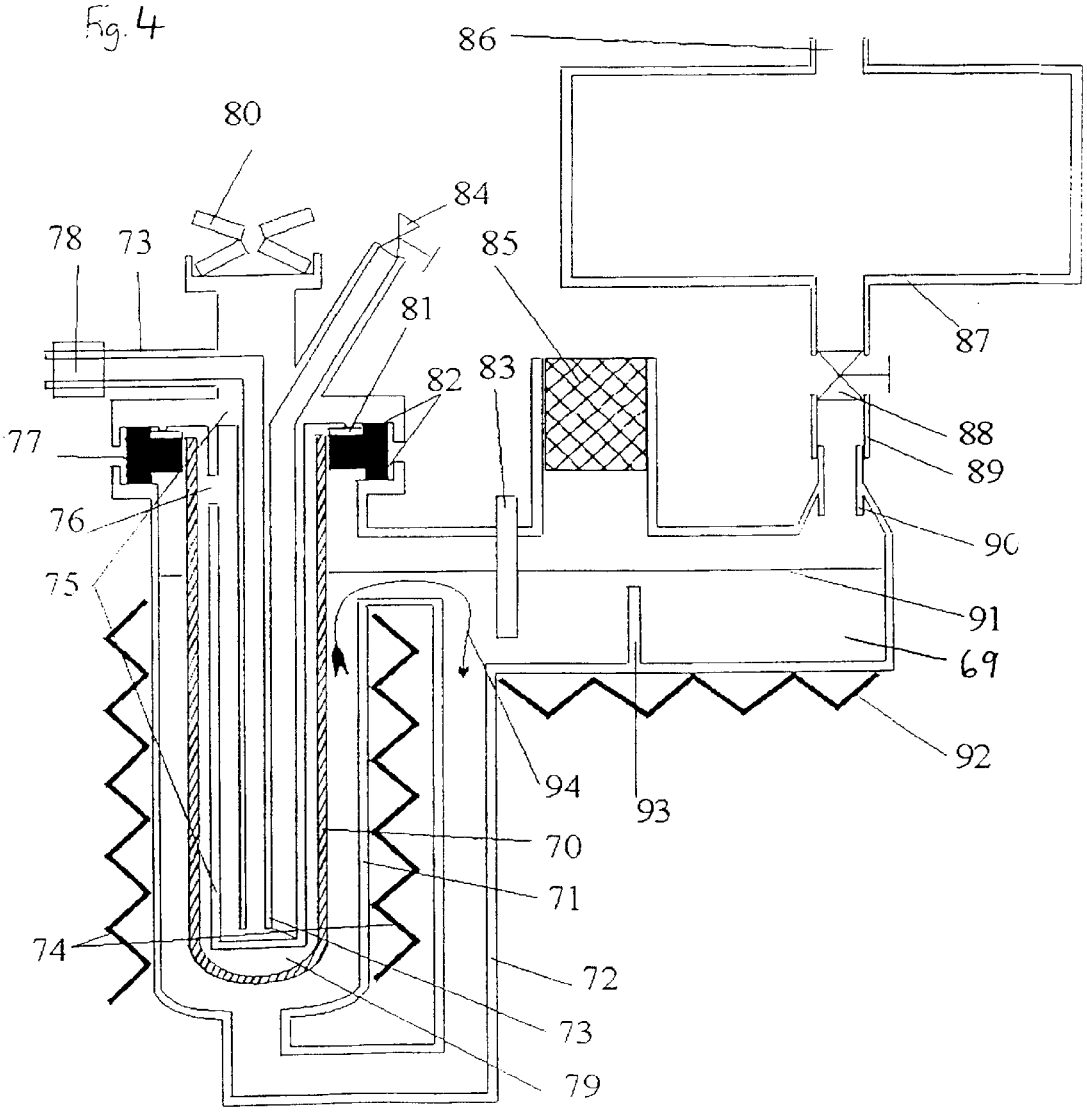
FIG. 4 is a cross-sectional representation of an alternative embodiment of the invention.

In FIG. 4, the gas created at the cylindrical anode or first electrode, 71 accumulates in the metal source material in the annular space between space between the anode and the thimble shaped solid electrolyte 70. The gas rises and carries the source material 69 with it to the surface, the typical level of which is indicated by 91. The gas leaves the source material and rises to the vapour trap or filter 85 before being expelled from the device (through a suitable tube if required). The degassed source material then sinks to the bottom of the device again through pipe 72. The source material therefore circulates in the direction shown by arrow 94.

The heater for the electrolysis compartment 74, surrounds the anode. There is a heater 92 for the source material heating compartment, and a partition 93 divides the two compartments preventing thermal shock of the electrolyte when valve 88 is opened to let fresh, cold, source material in via feed pipe 90.

A flexible piece of conducting material 79 is positioned solid electrolyte 70 in order to make the first electrical contact between the electrolyte and the second electrode 75. Once electrolysis has started, sodium fills the electrolyte until it reaches port 76 and electrical contact is thereby established to most of the inside of the electrolyte. The second electrode or cathode 75 contains a port through which the sodium metal produced by the electrolysis flows. The molten sodium falls to the bottom of the hollow cathode and using pressurized gas it can be pumped through pipe 73 to the melt in the vessel (not shown). The pressurized gas is introduced via valve 84 and if it is desired to monitor the flow rate of sodium a sensor 78 can be fitted. A feed-back control system for the flow rate of sodium could be established using sensor 78 and valve 84. An alumina collar 77 is attached to the solid electrolyte using a suitable gas-tight material, for instance ceramic cement and/or gas, and both electrodes are sealed against it. The figure shows an example of a sealing mechanism where graphite based gaskets 82 are pressed hard between the electrode they are in contact with and the alumina ring. This pressure is created by a suitable mechanism that compresses spring 80 towards the anode sealing surface. A knife edged protruding ring on the cathode 117 cuts into the aluminium ring 81 and prevents sodium contacting the graphite. A protruding ring 116 on the anode prevents the graphite gaskets from being compressed too much or unevenly, since uneven compression could make the electrolyte contact one of the electrodes and break. Additional insurance against this happening is provided by the rings 95 on the anode and cathode which maintain even spacing between the electrolyte and both electrodes.

A tank of liquid source material 87 is connected to the device using a flexible tube 89. If, for any reason excess pressure builds up within the device (for instance if the source material is an aqueous solution and trap 85 in the gas outlet port becomes blocked preventing the steam released from the evaporation of the water being released), tube 89 will detach from pipe 90 and source material will no longer enter the device. There is an air vent 86 to equalize the pressure in container 87.

Figure 5:
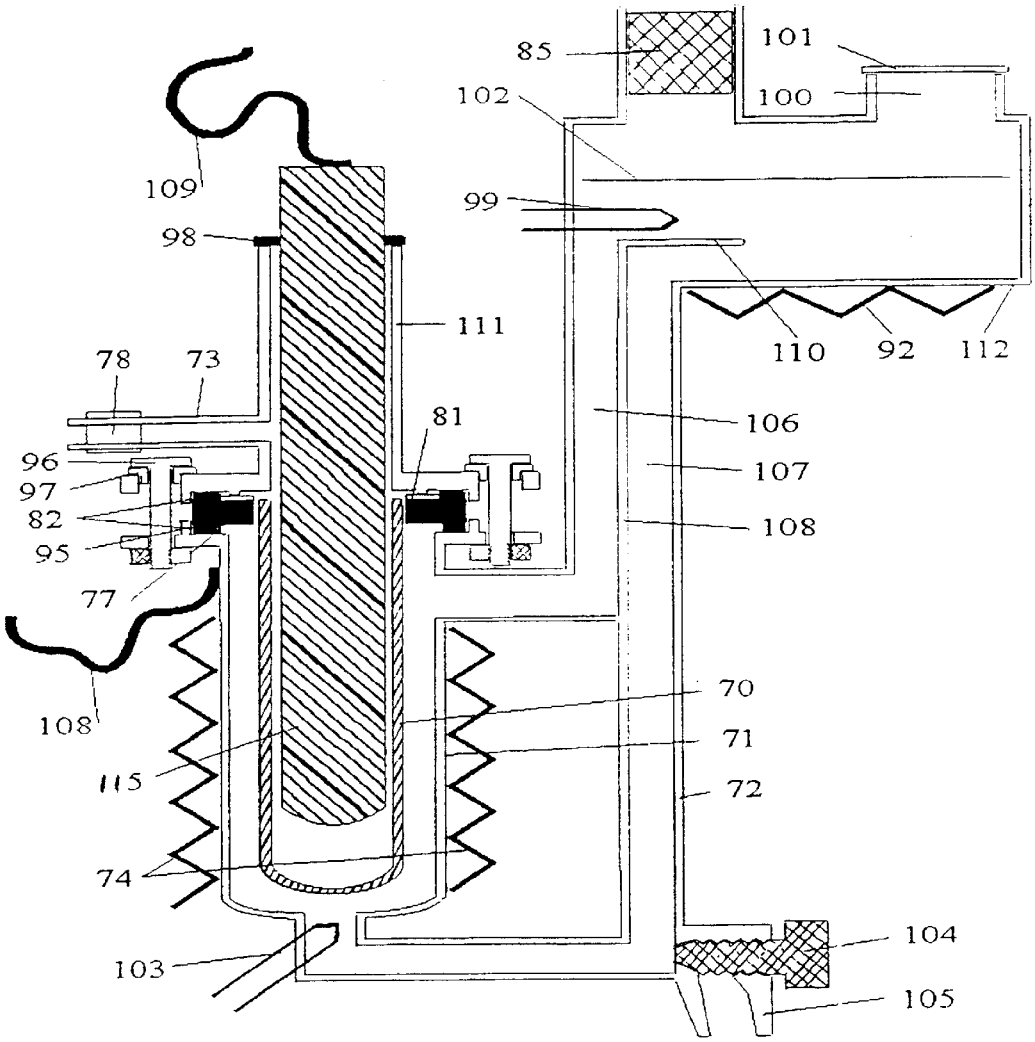
FIG. 5 is a cross-sectional representation of an additional embodiment of the invention.

FIG. 5 shows a cross-sectional representation of another embodiment of the invention which has features specifically adapted for the use of a relatively low boiling point source material. Source material is carried up the pipe or channel 106 by the gas formed inside the anode 71. The gas leaves the source material when it enters holding tank 112 and then it leaves the tank through the mist filter 85. Fresh source material is added through port 100 by removing the cover or lid 101 so that the level is maintained near the line 102. Baffle 110 is present to ensure that the source material entering channel or pipe 107 contains the minimum amount of gas. The gas free source material in 107 is heavier than the gas containing material in 106 which promotes circulation of material in the space between anode 71 and electrolyte 70. The holding tank 112 is high to cause more rapid circulation so that the distance between anode 71 and electrolyte 70 can be minimized to minimize the resistance of the electrolysis circuit. Thermocouple 99 is used by a feedback control circuit to switch heater 92 on and off to maintain the material in tank 112 at an optimum temperature. The barrier at 108 can serve as a heat exchange surface so that the material in 106 is cooled by the material in 107 which is in turn heated. This allows the temperature at thermocouple 103 to be significantly higher than at 99. The heater 74 will help maintain this difference. This feature allows the electrolysis compartment to be operated at a temperature close to, or even above, the boiling point of the source material. For instance, if the source material is sodium carbonate dissolved in acetamide, the acetamide is costly and it is desirable to minimize its loss by evaporation. Typically the electrolysis compartment should be kept at a temperature close to the boiling point of acetamide which would cause unacceptably rapid evaporation in tank 112 if it was not cooled by heat exchange at surface 108. In addition there may be a condensation unit (not shown) associated with the mist trap 85.

The cylindrical cathode 115 can be moved up and down in guide 111 and through seal 98. As metal is pumped into the electrolyte by electrolysis the cathode will rise. When metal is needed in the vessel, the cathode is pressed down and the metal flows through pipe 73 which leads to the vessel (not shown). There is a sensor 78 for the rate of flow of the metal. The position of the cathode is preferably controlled by a gas operated mechanism, or by a solenoid (or by other suitable mechanical means). The collar 77 and compressible rings 82 form a seal as previously described but compression force comes from three or more bolts 96. These are prevented from electrically shorting the electrodes together by insulating spacers 97. The cathode guide 111 is long to ensure that the cathode does not hit the electrolyte and also to keep the seal 98 as cool as possible. Items 113 and 109 are electrical leads for the electrolysis current to the anode and cathode respectively.

A drain plug 104 is provided so that the source material can be drained through pipe 105 to allow the thimble to be changed and/or to remove the accumulated impurities from the source material after a period of use.

It will be appreciated that in the embodiments shown in FIGS. 1 to 5, should the thimbles crack, any molten material flowing out of the cracked thimbles will freeze in the metal outlet pipe thereby preventing any dangerous flow of molten material into the melt. It may be desirable to add thermal and electrical insulation to a number of the parts illustrated in FIGS. 1 to 5. Suitable arrangements will also be needed to mount the device near the vessel. Control of the electrolysis current using information from a metal sensor in the melt is also desirable. All devices described could be extended by using multiple solid electrolyte pieces. It is also possible to mount the thimble shaped electrolytes horizontally instead of vertically as illustrated in the figures.

Figure 6:
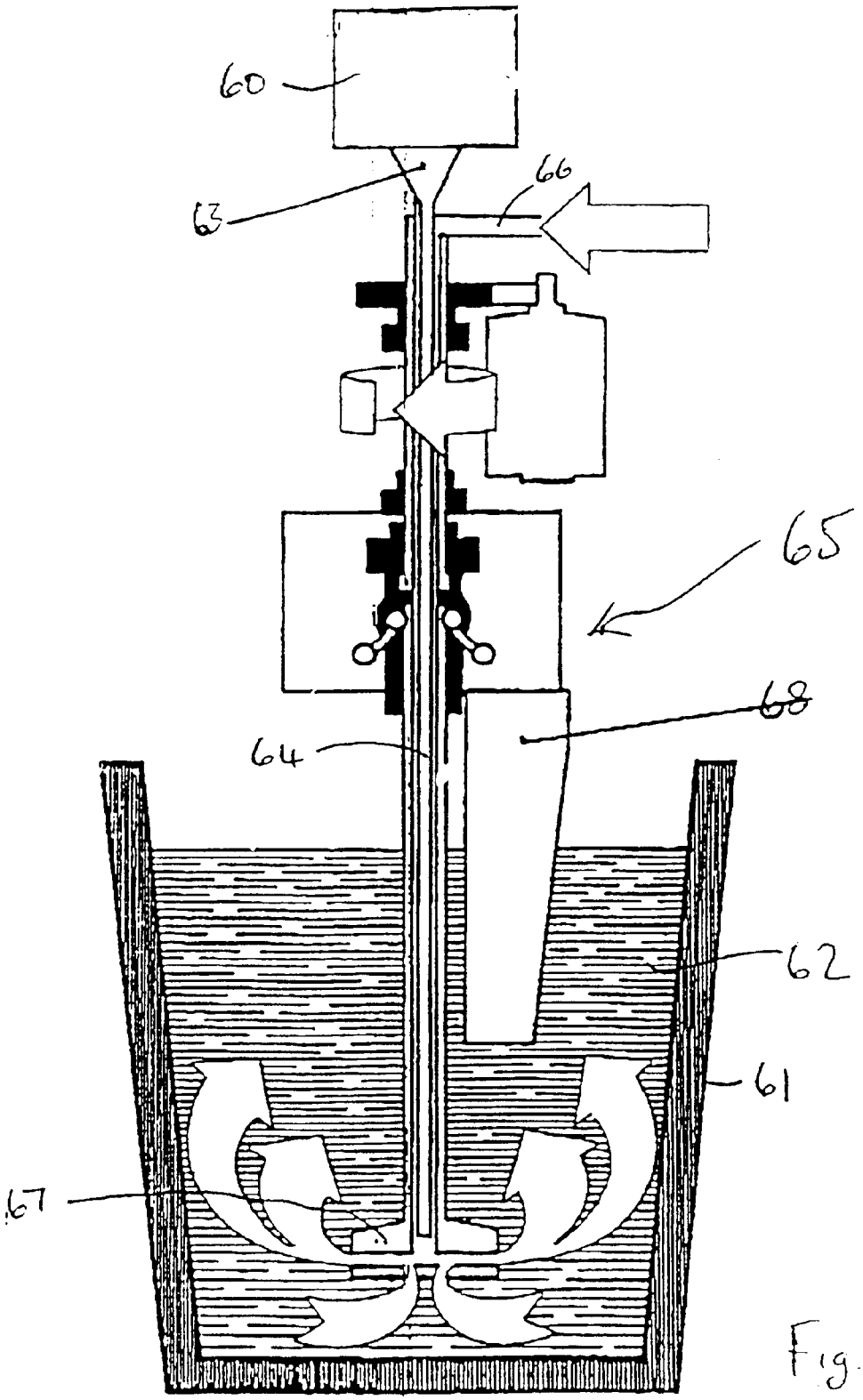
FIG. 6 is a schematic arrangement of a further embodiment of the invention.

In FIG. 6 is shown an apparatus to improve the diffusion of molten metal, e.g. sodium, into a melt of, e.g. aluminium.

Item 60 represents the apparatus of the invention to produce electrolytically the required molten sodium outside of a container 61 of aluminium melt 62. The molten sodium flows downwardly through a feeding tube 63 in the base of apparatus 60 and from there into the hollow shaft 64 of a rotor 65. Shaft 64 extends into the melt 62 and distributes inert gas via feed line 66 and the sodium into the melt through head 67 of the rotor.

Rotor 65 is preferably of the construction described in European Patent No. 0332292. Excellent distribution of material fed through the rotor into the melt is achieved as indicated by the arrows in the melt. A baffle 68 is positioned in the melt to reduce turbulence.

What is claimed is:

1. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof; and e) causing the ions to combine with electrons on the second side of the wall and then to flow as a molten metal from the container into the melt, wherein a compound of the metal is provided according to c) which is a hydroxide, carbonate, or oxalate salt of the metal.

2. A method as recited in claim 1 in which the container is for a molten compound of the metal, and further comprising heating the compound of the metal to molten form.

3. A method as recited in claim 1 wherein a metal is provided according to step c) which is a metal from Group 1A of the Periodic Table.

4. A method as recited in claim 1 wherein a sodium or lithium metal is provided according to step c).

5. A method as recited in claim 1, which comprises positioning a first electrode in the molten compound, and positioning a second electrode beyond or at the second side of the wall of the solid-state electrolyte; and wherein step d) is practiced by passing a current between the first and second electrodes.

6. A method as recited in claim 5 wherein the first electrode is an anode and the second electrode is a cathode which provides a source of electrons; and wherein step e) is practiced by causing the ions to combine with the electrons provided by the cathode.

7. A method as recited in claim 5 wherein the first electrode is comprised of nickel, stainless steel, or graphite, and wherein the second electrode is comprised of nickel, iron, or steel.

8. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof; and e) causing the ions to combine with electrons on the second side of the wall and then to flow as a molten metal from the container into the melt, wherein the melt material to which the metal is added comprises an aluminum or zinc melt.

9. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof; and e) causing the ions to combine with electrons on the second side of the wall and then to flow as a molten metal from the container into the melt, wherein a sodium or lithium metal is provided according to step c), and wherein the melt material to which the metal is added comprises an aluminum or zinc melt.

10. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof; and e) causing the ions to combine with electrons on the second side of the wall and then to flow as a molten metal from the container into the melt, wherein a compound of the metal is provided according to c) which is a hydroxide, carbonate, or oxalate salt of the metal; and wherein the melt material to which the metal is added comprises an aluminum or zinc melt.

11. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof; and e) causing the ions to combine with electrons on the second side of the wall and then to flow as a molten metal from the container into the melt, wherein prior to step d), the method comprises initiating electrolytic decomposition by at least one of contact between the second side of the wall of the solid-state electrolyte and by providing some molten metal in contact with the second side of the wall of the solid-state electrolyte.

12. A method of adding a metal to a melt of a material in a vessel, said method comprising:

a) positioning a container outside the vessel;

b) positioning within the container a solid-state electrolyte having a wall which includes first and second sides and comprising a conductor for ions of the metal;

c) providing a molten compound of the metal, or a solution of a compound of the metal, in the container;

d) electrolytically decomposing the compound so that ions of the metal are caused to pass through the wall of the solid-state electrolyte from the first side to the second side thereof;

e) causing the ions to combine with electrons on the second side of the wall and then to flow as a molten metal from the container into the melt, and (e) transporting the molten metal in to the melt in a stream of inert gas.

13. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall; and means for electrolytically decomposing the compound so that ions of the metal are caused to pass through said wall of said solid-state electrolyte from said first side to said second side thereof and to combine with electrons on said second side of the wall and then to flow as a molten metal to said vessel, wherein said electrolytically decomposing means comprises a plurality of first electrode, electrolyte, and second electrode combinations, each in the form of a module, wherein said first electrode of said combinations is positioned in contact with the molten compound, and wherein said second electrode of said combinations is positioned beyond or at said second side of said wall of said solid-state electrolyte.

14. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel; and a metal compound storage container for replenishing electrolytically decomposed metal compound during use, wherein said storage container includes means enabling draining of metal compound after a period of use.

15. Apparatus as recited in claim 14 wherein said storage container comprises means for heating the metal compound until the metal compound melts.

16. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel; and a metal compound storage container for replenishing electrolytically decomposed metal compound during use, wherein said storage container comprises means for heating the metal compound until the metal compound melts, and wherein said storage container enables a solution of the metal compound to be boiled away and the resulting metal compound to be melted.

17. Apparatus as recited in claim 13, 14, 15 or 16 wherein said solid-state electrolyte is formed from sodium or lithium beta alumina.

18. Apparatus as recited in claim 13, 14, 15 or 16 further comprising a conduit transporting the molten metal into the melt in said vessel.

19. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel, and a stream of inert gas for transporting the molten metal into the melt.

20. Apparatus as recited in claim 19 further comprising a pressure gauge which monitors the pressure of the stream of inert gas.

21. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel; and a conduit transporting the molten metal into the melt in said vessel, wherein said conduit comprises a rotor.

22. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel;

a conduit transporting the molten metal into the melt in said vessel; and a sensor which measures the rate of flow of the molten metal through the conduit.

23. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel;

a conduit transporting the molten metal into the melt in said vessel;

a stream of inert gas for transporting the molten metal into the melt through said conduit; and a shut-off valve in said conduit to prevent oxidation of the molten metal if the flow of inert gas is stopped.

24. Apparatus as recited in claim 13, 14, 15, 16, 19, 21, 22 or 23 further comprising means for temporarily storing the molten metal.

25. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel; and a sensor for the metal inserted or insertable into the melt, for monitoring and controlling the amount of the metal added to the melt.

26. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall;

means for electrolytically decomposing the compound so that ions of the metal are caused to pass through said wall of said solid-state electrolyte from said first side to said second side thereof and to combine with electrons on said second side of the wall and then to flow as a molten metal to said vessel; and a pump which conveys the melt material out of said vessel for addition to the metal to the melt material at a location exterior of said vessel.

27. Apparatus according to claim 26 wherein said pump conveys the melt material into, or adjacent to, apparatus for addition to the molten metal to the melt material.

28. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall; and means for electrolytically decomposing the compound so that ions of the metal are caused to pass through said wall of said solid-state electrolyte from said first side to said second side thereof and to combine with electrons on said second side of the wall and then to flow as a molten metal to said vessel, wherein said electrolytically decomposing means comprises a nickel, stainless steel, or graphite first electrode positioned in contact with the molten compound and a nickel, iron or steel second electrode positioned beyond or at said second side of said wall of said solid-state electrolyte.

29. Apparatus for adding a metal to a melt of a material, comprising:

a vessel containing the melt of a material;

a container positioned outside said vessel, and containing a molten compound of the metal or a solution of a compound of the metal;

a wall positioned inside said container and formed of a solid-state electrolyte which is a conductor for ions of the metal, said wall having a first side and a second side;

a source of electrons at said second side of said wall; and means for electrolytically decomposing the compound so that ions of the metal are caused to pass through said wall of said solid-state electrolyte from said first side to said second side thereof and to combine with electrons on said second side of the wall and then to flow as a molten metal to said vessel, wherein said electrolytically decomposing means comprises a first electrode positioned in contact with the molten compound and a second electrode positioned beyond or at said second side of said wall of said solid-state electrolyte, wherein said first electrode comprises an anode and said second electrode comprises a cathode; and wherein said cathode comprises said source of electrons which combine with the ions.

* * * * *